US006414670B1

(12) United States Patent
Kim

(10) Patent No.: US 6,414,670 B1
(45) Date of Patent: Jul. 2, 2002

(54) GATE DRIVING CIRCUIT IN LIQUID CRYSTAL DISPLAY

(75) Inventor: Byung Doo Kim, Kyungsangbuk-do (KR)

(73) Assignee: LG Semicon Co., Ltd., Chungcheongbuk-Do (KR)

( * ) Notice: Subject to any disclaimer, the term of this patent is extended or adjusted under 35 U.S.C. 154(b) by 0 days.

(21) Appl. No.: 09/282,159

(22) Filed: Mar. 31, 1999

(30) Foreign Application Priority Data

Aug. 24, 1998 (KR) ..... 98/34290

(51) Int. Cl.[7] ..... G09G 3/36

(52) U.S. Cl. ..... 345/98; 345/99; 345/100; 345/87; 345/211; 345/213

(58) Field of Search ..... 345/98, 99, 100, 345/211, 213, 87

(56) References Cited

U.S. PATENT DOCUMENTS 5,877,737 A * 3/1999 Kim et al. ..... 345/89
5,945,970 A * 8/1999 Moon et al. ..... 345/92
6,020,873 A * 2/2000 Hori ..... 345/132

FOREIGN PATENT DOCUMENTS

EP 497378 A2 * 1/1992 ..... 345/100

OTHER PUBLICATIONS

LG Semicon Co., Ltd., 150 CH/154 CH TFT–LCD Gate Drive Specification Version 1.0 Jul. 21, 1998, pp. 1–16.

* cited by examiner

*Primary Examiner*—Xiao Wu
*Assistant Examiner*—Ali Zamani
(74) *Attorney, Agent, or Firm*—Morgan, Lewis & Bockius LLP

(57) ABSTRACT

A gate driving circuit in a liquid crystal display is disclosed which can minimize a power consumption by avoiding unnecessary drive of gate line drivers. The gate driving circuit is used in a liquid crystal display having a liquid crystal panel with thin film transistors and pixel electrodes for displaying an image, a source driving circuit for applying video data to a source line in the liquid crystal panel, and a gate driving circuit for applying a driving signal to a gate line in the thin film transistors. The gate driving circuit includes a plurality of gate line drivers connected in series for applying the driving signal to the gate line, and a plurality of clock generation controlling units corresponding to the plurality of gate line drivers each for controlling a timing of a clock signal to a respective gate line driver, thereby controlling a driving timing of the respective gate line driver.

16 Claims, 10 Drawing Sheets

GATE DRIVING CIRCUIT IN LIQUID CRYSTAL DISPLAY

This Application claims the benefit of Korean application no. 34290/1998 filed on Aug. 24, 1998, which is hereby incorporated by reference.

BACKGROUND OF THE INVENTION

1. Field of the Invention

The present invention relates to a liquid crystal display, and more particularly, to a gate driving circuit in a liquid crystal display.

2. Background of the Related Art

Referring to FIG. 1*a*, a liquid crystal display is, in general, provided with a liquid crystal panel 11, a driver unit 12 having a plurality of gate line drivers (GD) around the liquid crystal panel 11, and a source line driver unit 13 having a plurality of source line drivers (SD). As shown in FIG. 1*b*, the liquid crystal panel 11 is provided with a plurality of gate lines G1, G2, G3, - - - , Gn, a plurality of source lines S1, S2, S3, - - - , Sn in a direction crossing each of the gate lines, a thin film transistor 11*a* formed at a crossing point of the gate lines and the source lines, and a liquid crystal capacitor 11*b* connected to its respective thin film transistor 11*a*.

In order to display an image on the liquid crystal display, after applying a driving signal to the gate lines in a sequence, a data signal is applied to the source lines, causing a change of the orientation of liquid crystal stored in the respective liquid crystal stored in the respective liquid crystal capacitors, thus displaying an image on the liquid crystal panel 11. The driving signal applied to the gate lines is provided from the gate line drivers GD. And, the data signal applied to the source lines is provided from the source line drivers SD. At least one gate line drivers GD and source line drivers SD are provided depending on the size of the liquid crystal panel.

FIG. 2 illustrates details of the gate line driver GD. The gate line driver GD includes a level changing unit 21, a shift registering unit 22, a level shifting unit 23, and a buffering unit 24. The level changing unit 21 changes a level $V_{DL}$ or $V_{DD}$ of an external signal into a level Vss or $V_{DD}$ required for the system operation. The shift registering unit 22 is provided with 154 shift registers SR1~SR154, each operative in response to a signal level changed by the level changing unit 21, for shifting a driving signal applied to the gate line in a sequence. The level shifting unit 23 is provided with 154 level shifters LS1~LS154, each for shifting a level of the driving signal from the shift registering unit 22 to a level Vss or $V_{COM}$.

The buffering unit 24 outputs signals out1~out154 which are applied to the gate lines in a sequence. For example, initially when the first buffer BF1 provides a high signal $V_{COM}$, the remaining buffers provide a low signal $V_L$. Then, the buffering unit 24 is shifted, so that in this time, the second buffer BF2 provides a high signal, while the remaining buffers including the first buffer BF1 provide a low signal. Thus, the high signal is applied starting from the first buffer BF1 to the $154^{th}$ buffer BF154 in a sequence for applying the high signal starting from the first gate line to the $154^{th}$ gate line in the liquid crystal panel 11 in sequence.

The number of the gate line driver GD changes according to the size of the liquid crystal panel 11. For example, if four gate line drivers GD are provided, the number of the gate lines in the liquid crystal panel 11 will be 154×4=616.

As shown in FIG. 2, each of the gate line driver GD applies a signal from the buffering unit 24 to the gate line with either a high or low signal depending on received signals STV1, STV2, CPV, and OE. The STV1 and the STV2 signals are shift data input/output signals, i.e., bidirectional signals. When an arbitrary one of the plurality of gate drivers completes providing all the 154 signals in sequence, the next one comes into operation. The STV1 signal is an operation signal provided to the forward gate line driver, and the STV2 is an operation signal provided to the backward gate line driver. Accordingly, upon receiving the STV1 signal, the arbitrary gate line driver provides the STV2 signal to the next gate line driver after applying a driving signal to the gate line. The CPV signal is a vertical shift clock signal and the OE signal is an output enable signal.

FIG. 3 illustrates the operation waveform diagram of the gate line driver. Referring to FIG. 3, the STV1 signal is provided at a first falling edge of the CPV signal (clock signal), shifted to the second shift register SR2 through the first shift register SR1, and passed through the first level shifter LS1 and the buffer BF1, to provide a high level out1 signal to be applied to the first gate line at a second rising edge of the CPV signal. Then, the signal shifted to the second shift register SR2 at the next falling edge of the CPV signal is shifted to the third shift register SR3, passed through the second level shifter LS2 and the second buffer BF2, and provides a high level out2 signal to the second gate line at a third rising edge of the CPV signal. Thus, out1 to out 154 signals are provided in sequence matched to the rising edges of the clock signal clk according to the foregoing method. After providing the signals out1 up to out154, the STV2, an operation signal for the next gate line driver, is provided. The STV2 signal, being equivalent of the STV1 signal for the next gate line driver, provides 154 signals in sequence as explained before.

FIG. 4 illustrates a conventional gate driver circuit. Referring to FIG. 4, the gate driver circuit is provided with a plurality of gate line drivers connected in series. A first gate line driver 41-1 is synchronous to a clock signal CPV and operative in response to a driving signal of the STV signal. The first gate line driver 41-1 provides a STV2 signal to a second gate line driver 41-2 at a moment its own $154^{th}$ signal is provided. Accordingly, the second gate line driver 41-2 provides signals out1 to out 154 in succession as explained before. Then, the second gate line driver 41-2 provides a STV2 signal to a third gate line driver 41-3 at a moment its own $154^{th}$ signal is provided. Thus, the plurality of gate line drivers connected in series in the conventional gate driving circuit are driven in succession.

With reference to the waveforms shown in FIG. 5, if one of the plurality of gate lines in the liquid crystal panel 11 is selected (i.e., a high signal is applied), other gate lines are applied with low signals. A driving signal (i.e., the high signal) applied to one of the gate lines is shifted in succession synchronous to every rising edge of the clock signal. Of the signals provided from the first gate line driver 41-1 in FIG. 4, when the signal out154 is provided, the STV2 signal is provided synchronized to the falling edge of the clock signal. The STV2, equivalent of the STV1 for the second gate line driver 41-2, causes the second gate line driver 41-2 to provide signals from out1 to out154 in succession. When all the gate line drivers complete all operation in succession, one image is displayed on the liquid crystal panel.

However, the conventional gate line driver circuit has the following problems. In the gate line driver circuit provided with the plurality of gate line drivers, all of the gate line drivers are provided with the clock signals continuously started from the driving of the first gate line driver until the driving of the last gate line driver. Accordingly, the unnecessary driving of gate line drivers due to unnecessary application of the clock signal causes an wasteful power consumption.

SUMMARY OF THE INVENTION

Accordingly, the present invention is directed to a gate driving circuit in a liquid crystal display that substantially obviates one or more of the problems due to limitations and disadvantages of the related art.

An object of the present invention is to provide a gate driving circuit in a liquid crystal display with minimized power consumption by eliminating the unnecessary drivings of gate line drivers.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the gate driving circuit of the present invention is to be used in a liquid crystal display having a liquid crystal panel with thin film transistors and pixel electrodes for displaying an image, a source driving circuit for applying a video data to a source line in the liquid crystal panel, and a gate driving circuit for applying a driving signal to a gate line in the thin film transistor. The gate driving circuit includes a plurality of gate line drivers connected in series for applying the driving signal to the gate line, and clock generation controlling units provided to correspond to the gate line drivers for controlling a timing of the clock signal to respective gate line drivers to control a driving timing of respective gate line drivers.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1A:
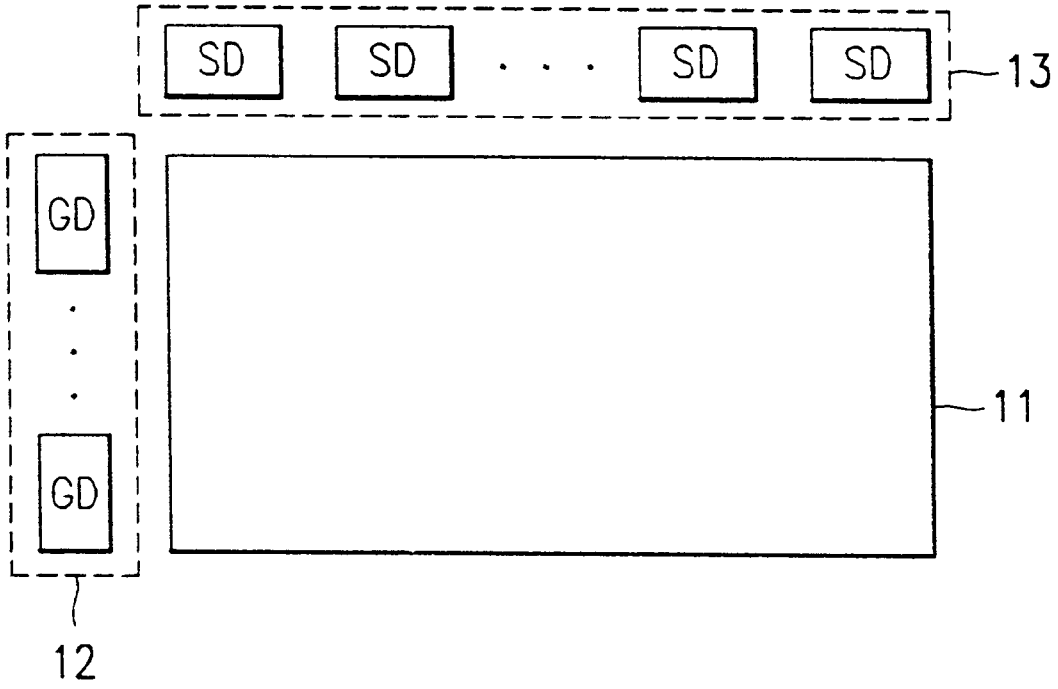
FIG. 1A Related Art
FIG. 1*a* illustrates a lay out of a general liquid crystal display.
Figure 1B:
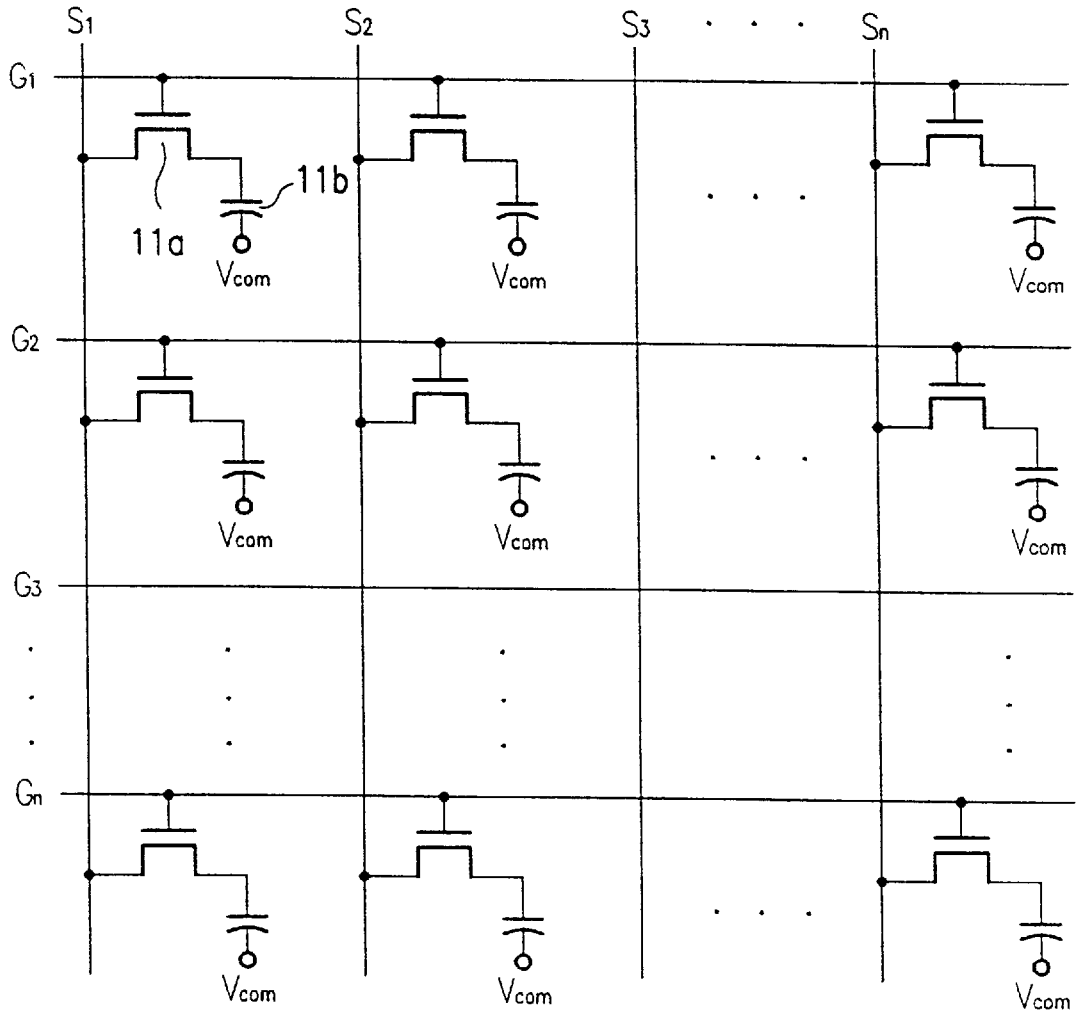
FIG.1B Related Art
FIG. 1*b* illustrates a system of the liquid crystal display shown in FIG. 1*a;*
Figure 2:
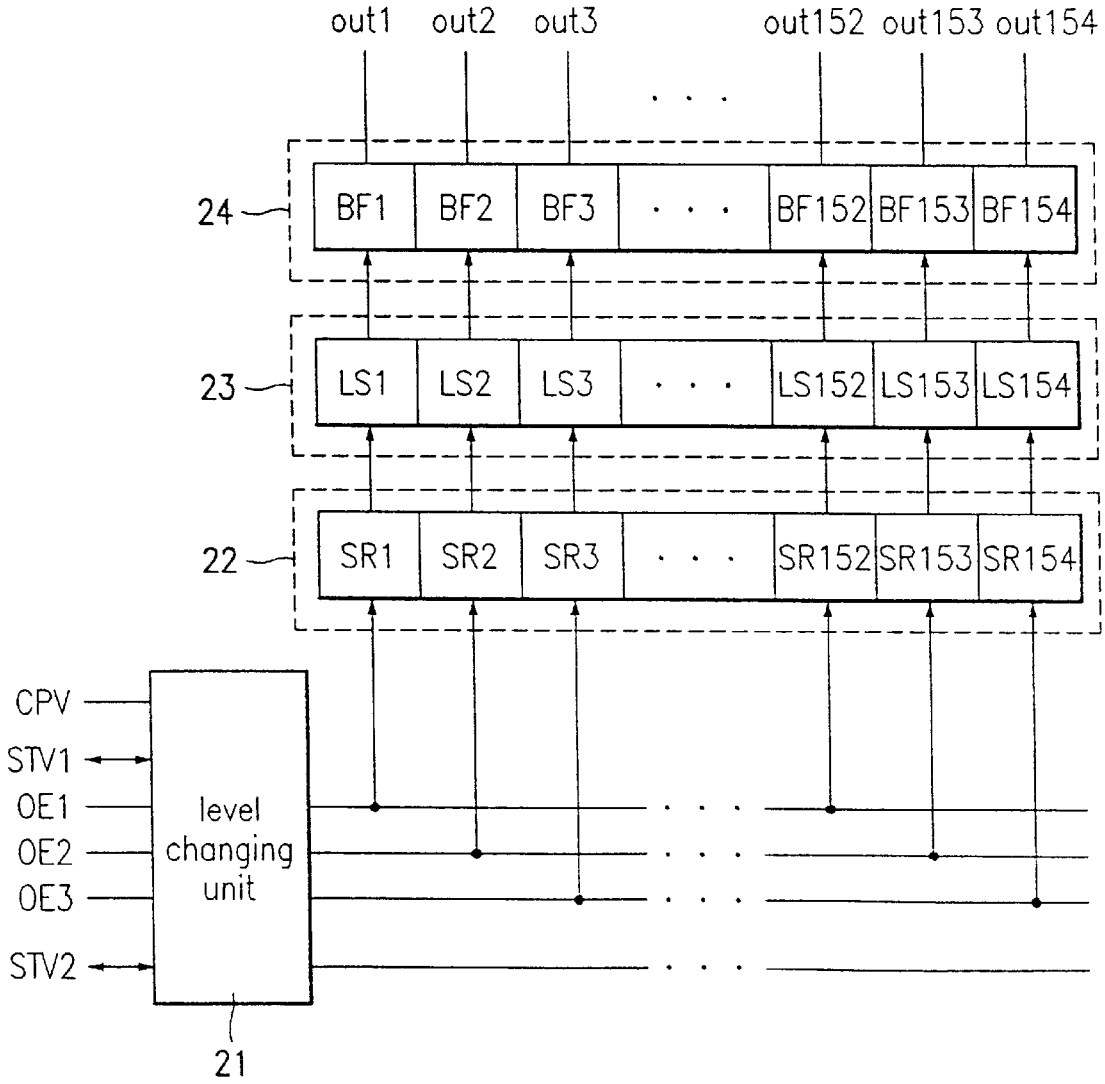
FIG.2 Conventional Art
FIG. 2 illustrates a conventional gate line driver in a liquid crystal display.
Figure 3:
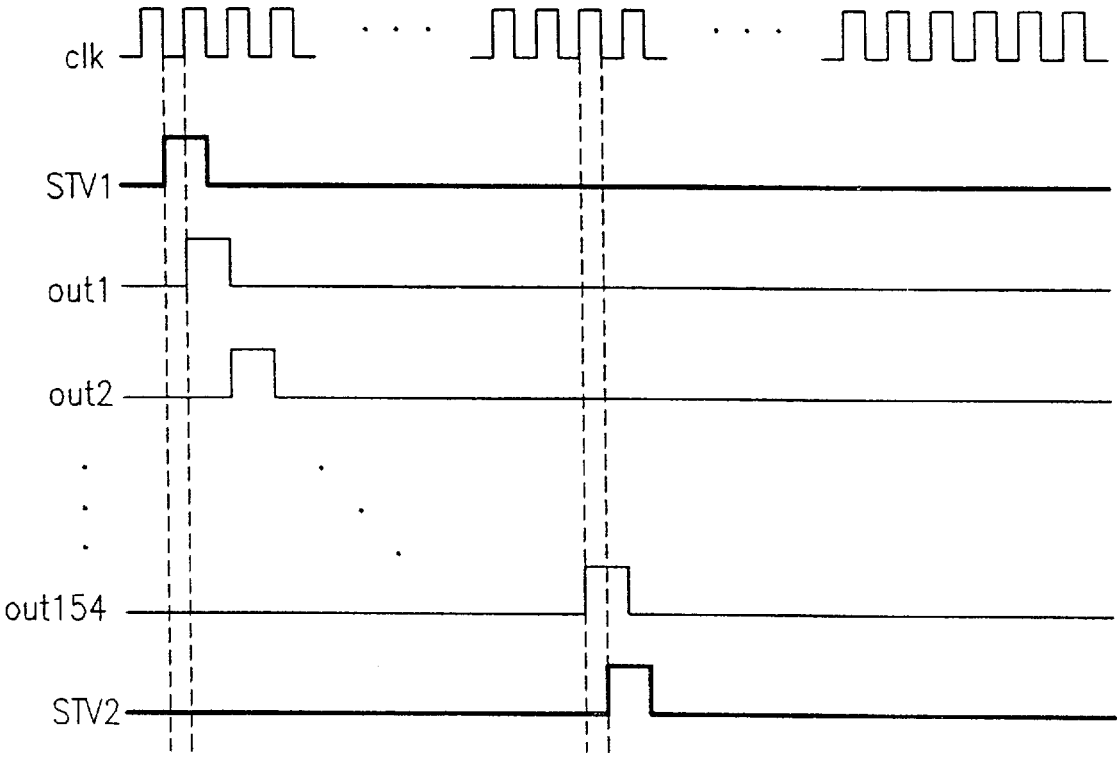
FIG.3 Conventional Art
FIG. 3 illustrates operation waveforms of the conventional gate line driver in a liquid crystal display.
Figure 4:
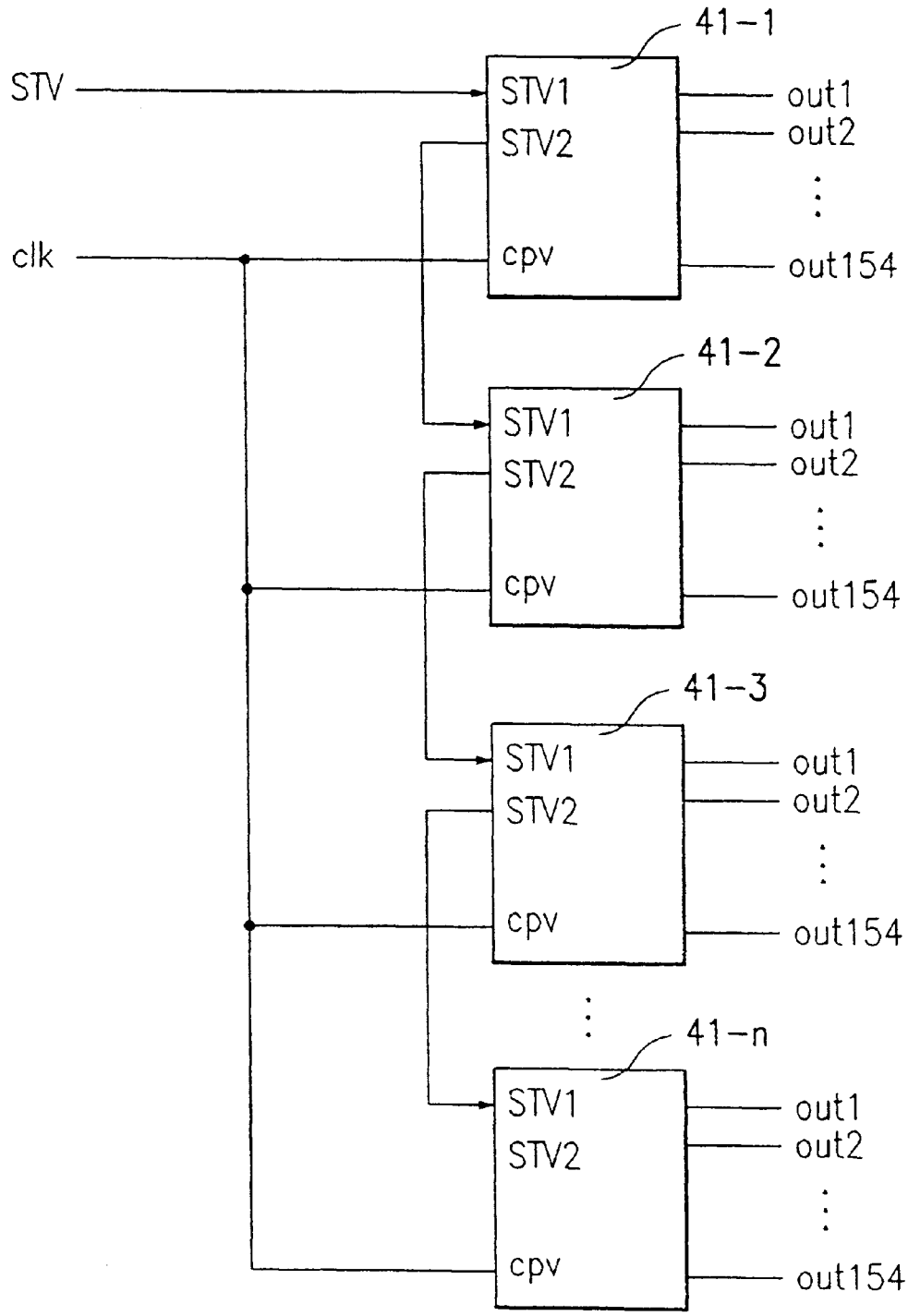
FIG.4 Conventional Art
FIG. 4 illustrates a conventional gate line driving circuit in a liquid crystal display.
Figure 5:
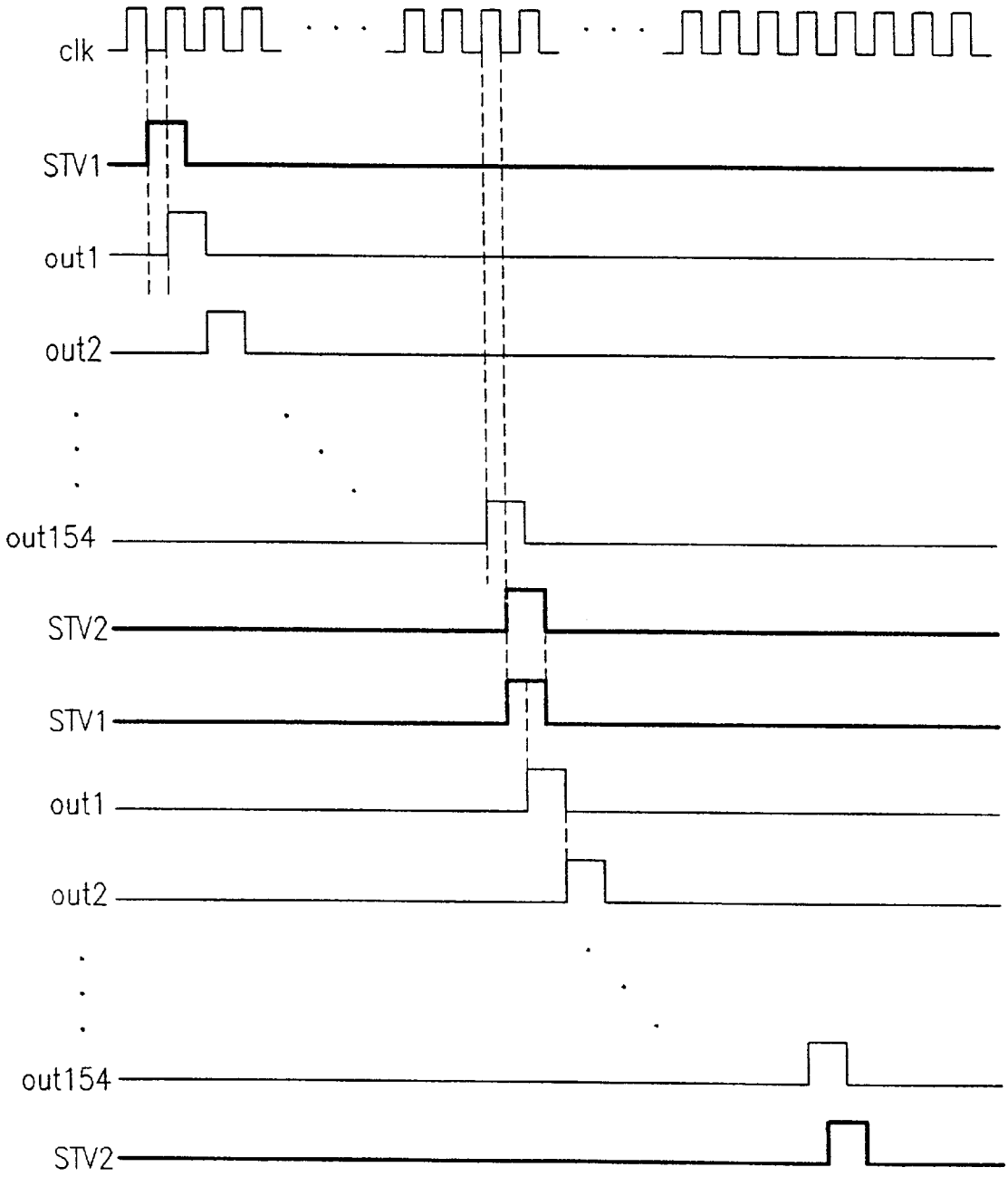
FIG.5 Conventional Art
FIG. 5 illustrates an operation waveform diagram of a conventional gate line driving circuit in a liquid crystal display.
Figure 6:
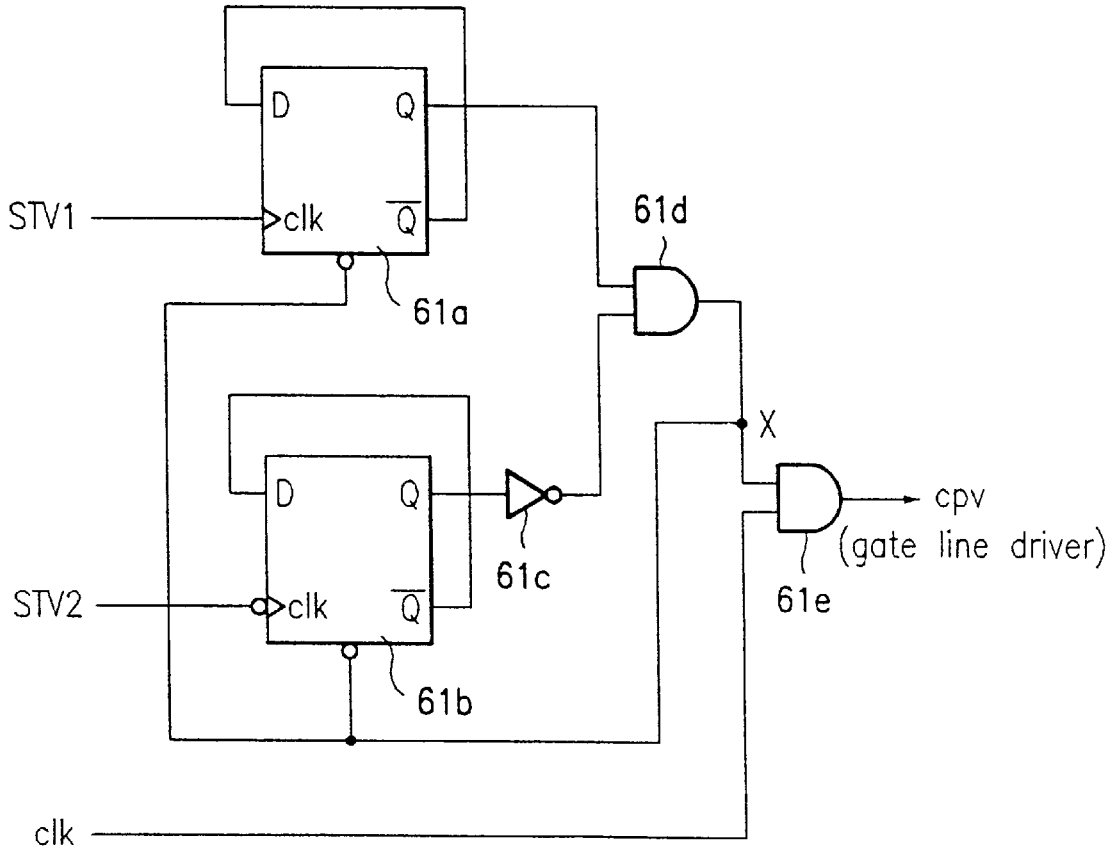
FIG. 6 illustrates a system of a clock generation controlling unit in accordance with a preferred embodiment of the present invention.

FIG. 6 illustrates a system of a clock generation controlling unit in accordance with a preferred embodiment of the present invention. Referring to FIG. 6, the clock generation controlling unit includes two T-flipflops 61*a* and 61*b*, an inverter 61*c*, and two AND gates 61*d* and 61*e*. A signal from the first flipflop 61*a* is provided to the first AND gate 61*d*, together with a signal from the second flipflop 61*b* passed through the inverter 61*c*. A signal from the first AND gate 61*d* is applied to reset terminals of the first, and second flipflops 61*a* and 61*b* as well as to the second AND gate 61*e*. A clock signal clk is also provided to the second AND gate 61*e*. An output terminal on the second AND gate 61*e* is connected to a gate line driver (not shown).

The operation of the clock generation controlling unit will be explained referring to FIG. 6. Acting as a reset signal for the first and second flipflops 61*a* and 61*b*, a signal from the first AND gate 61*d* is at a low level initially. The first flipflop 61*a*, provided with an STV1 signal as a clock signal, is of a positive edge trigger to be triggered at a rising edge of the STV1 signal to provide a high level signal. However, since the STV2 signal which acts as a clock signal for the second flipflop 61*b* is still at a low level, a signal from the second flipflop 61*b* is at a low state. The low level signal from the second flipflop 61*b* is changed to a high level as it passes through the inverter 61*c* and provided to the first AND gate 61*d*, together with the high level signal from the first flipflop 61*a*. Accordingly, the first AND gate 61*d* provides a high level signal.

The second AND gate 61*e* subjects a signal from the first AND gate 61*d* and the clock signal clk to AND operation. The second flipflop 61*b* is of a negative edge trigger, to be triggered at a falling edge of the STV2 signal to provide a high level signal. Therefore, since the signal from the first AND gate is turned to a low level while the signal from the first AND gate 61*d* is at a low level, the first flipflop 61*a* and the second flipflop 61*b*, receiving the STV1 and the STV2 as clock signals respectively, are reset.

Figure 7:
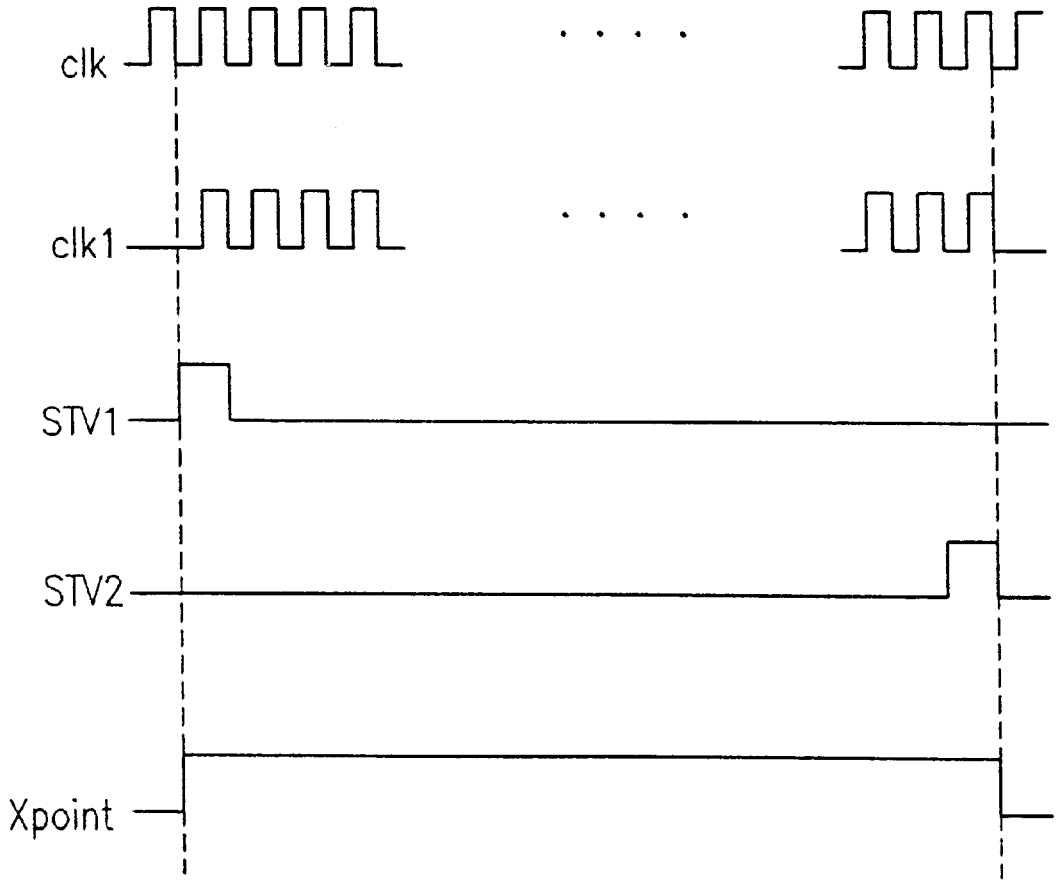
FIG. 7 illustrates an operation waveform diagram of the clock generation controlling unit shown in FIG. 6.

FIG. 7 illustrates an operation timing diagram of the clock generation controlling unit shown in FIG. 6. Referring to FIG. 7, the clock signal clk1, a CPV signal to the gate line driver (not shown), is provided only between a rising edge of the STV1 signal and a falling edge of the STV2 signal. Therefore, signals out1~out154, each triggered at a rising edge of the clk1 signal in succession, are provided to the gate line in succession. Once the STV1 signal is provided, the driving signals out1~out154 are provided, and the STV2 signal is provided at a falling edge of the $154^{th}$ signal. As shown in FIG. 7, a level of the X point shown in FIG. 6 is kept high from generation of the STV1 signal to generation of the STV2 signal. Accordingly, the second AND gate 61*e* receives a signal from the first AND gate 61*d* and the clock signal clk, and provide the clock signal clk to the gate line driver as it is.

Figure 8:
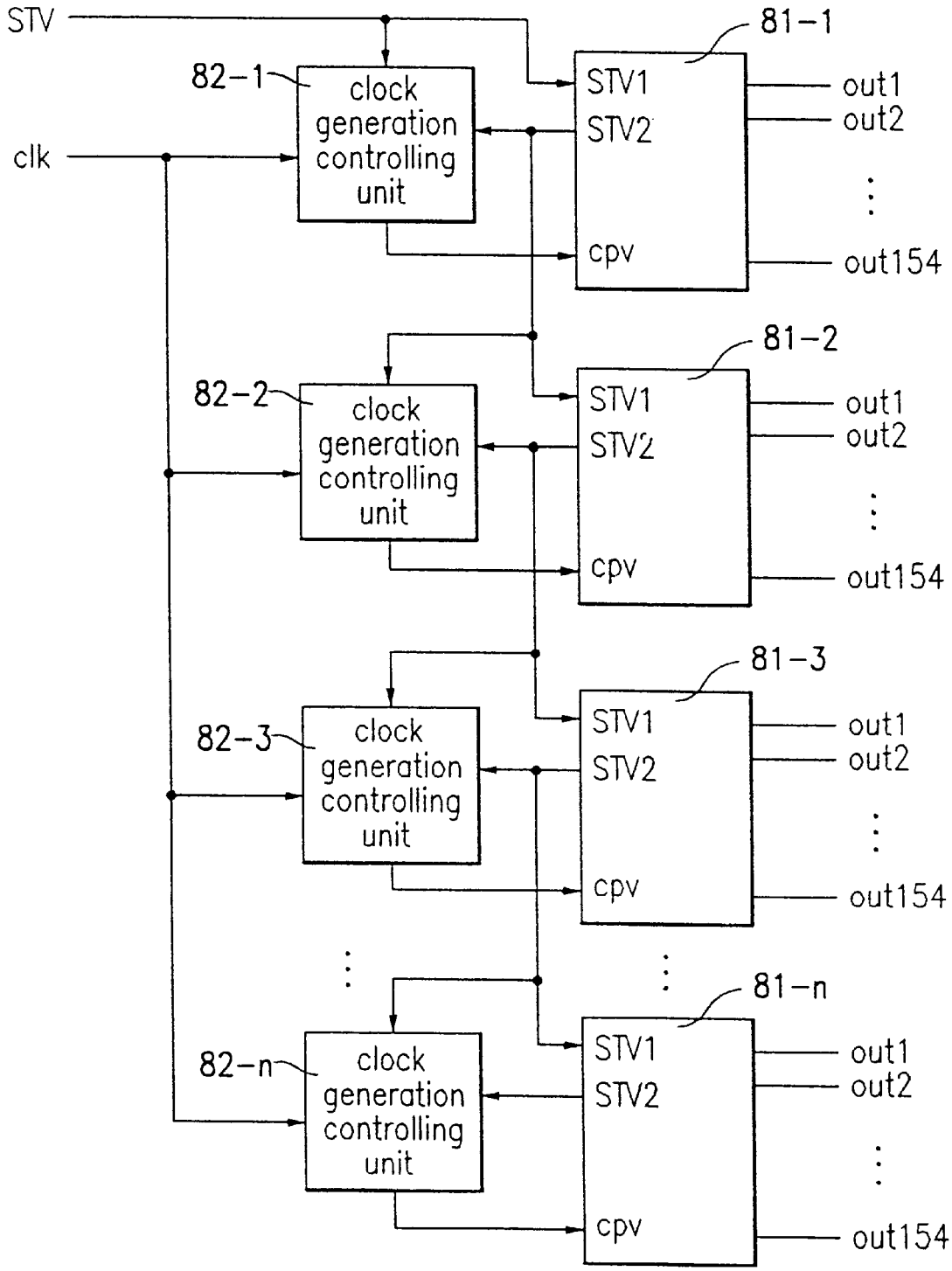
FIG. 8 illustrates a gate driving circuit in a liquid crystal display in accordance with a preferred embodiment of the present invention.

FIG. 8 illustrates a block diagram of a gate driving circuit in a liquid crystal display using the clock generation controlling units of FIG. 6.

Referring to FIG. 8, the gate driving circuit includes a plurality of gate line drivers 81-1, 81-2, 81-3, - - - , 81-n connected in series for operating in succession in response to the driving signal STV and the clock signal. The gate driving circuit also includes a plurality of clock generation controlling units 82-1, 82-2, 82-3, - - - , 82-n each adapted to control the clock signal to respective gate line driver for selective application thereto. The clock generation controlling units 82-1, 82-2, 82-3, - - - , 82-n are maintained at an enable state only when the gate line drivers 81-1, 81-2, 81-3, - - - , 81-n connected thereto is in operation, and are maintained at a disable state when the gate line drivers 81-1, 81-2, 81-3, - - - , 81-n not connected thereto is in operation. Thus, the clock signal provided to each of the gate line drivers 81-1, 81-2, 81-3, - - - , 81-n is controlled individually, and the clock signal is not applied to the gate line drivers which should not be driven.

In other words, in driving the plurality of gate line drivers in succession, a waste of power is reduced in the present invention by its specific design choices and the clock signal is not applied to all the gate line drivers except the particular gate line driver that applies a driving signal to a gate line presently.

As an alternative, each clock generation control unit may be provided within its respective gate line driver.

Figure 9:
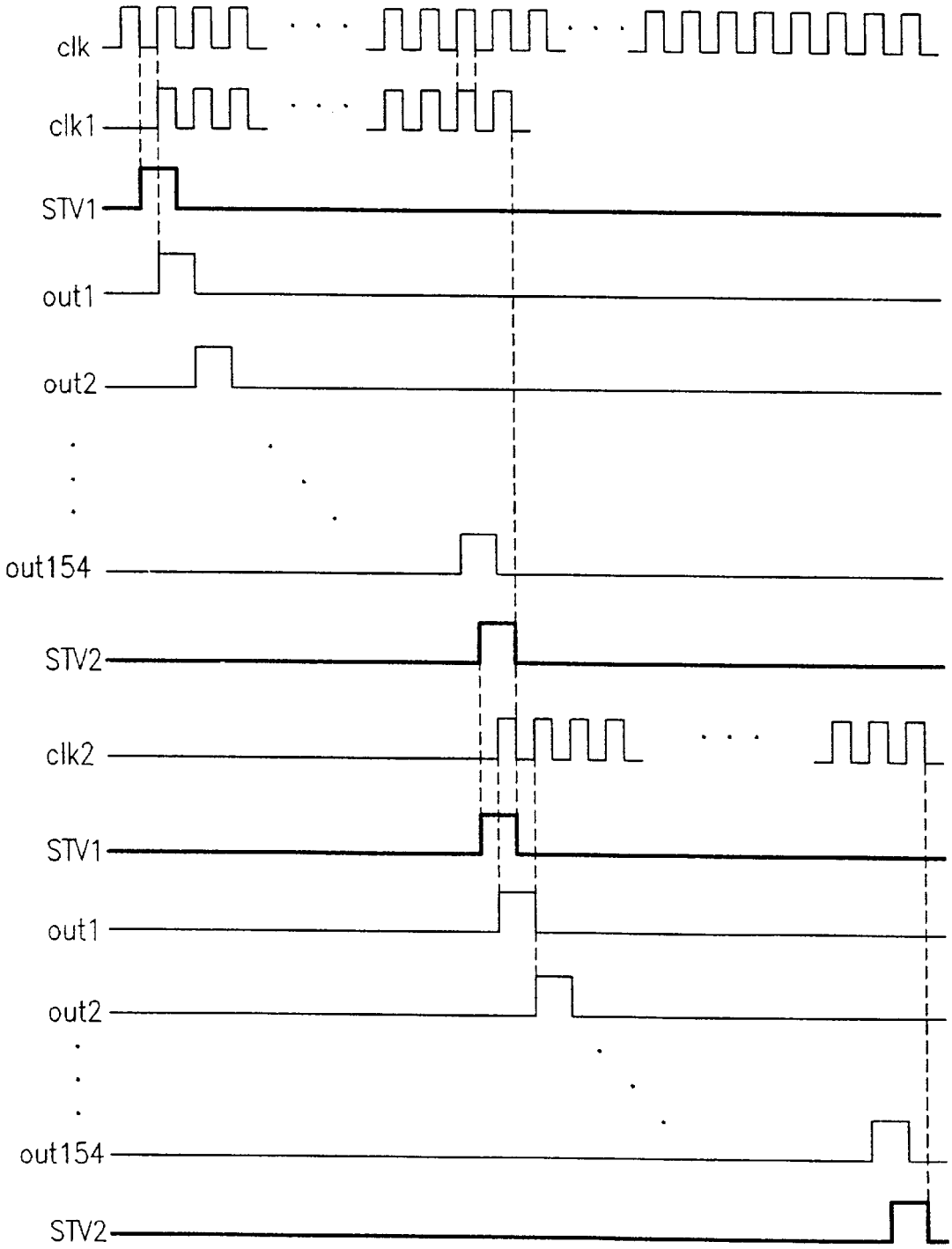
FIG. 9 illustrates an operation waveform diagram of the gate driving circuit in a liquid crystal display shown in FIG. 8.

This operation will be explained with reference to FIG. 9 which shows an operation timing diagram of the gate driving circuit of the present invention.

The clock signal clk1 used as a CPV signal to the first gate line driver 81-1 is provided only between a rising edge of the STV1 signal and a falling edge of the STV2 signal. Accordingly, triggered at a rising edge of the clk1 signal, signals out1~out154 are provided to the gate lines in succession. As the second gate line driver 81-2 receives the STV2 signal of the first gate line driver 81-1 as its equivalent STV1 signal, the second gate line driver 81-2 receives the clock signal clk2 between a rising edge of the signal and a falling edge of the STV2 signal of the second gate line driver 81-2. Accordingly, the signals out1~out154 provided from the second gate line driver 81-2 are triggered at rising edges of the clk2 signal and apply driving signals to respective gate lines.

Consequently, the clock generation controlling units 82-2, 82-3, - - - , 82-n control in a way such that no clock signal is applied to all the other gate line drivers 81-2, 81-3, - - - , 81-n when the first gate line driver 81-1 is applying a driving signal to the gate line. And, the clock generation controlling units 82-1, 82-3, - - - , 82-n control in a way such that no clock signal is applied to all the other gate line drivers 81-1, 81-3, - - - , 81-n except the second gate line driver 81-2, if the second gate line driver 81-2 comes into operation after the first gate line driver 81-1 finishes providing signals out1~out154 in succession. As a result, in the present invention, unnecessary power consumption is reduced by controlling, given that the clock signal is provided only to a gate line driver which drives an LCD gate line and no clock signal is provided to gate line drivers which provide no driving signals to the gate lines.

The foregoing gate driving circuit in a liquid crystal display of the present invention has the following advantages. The gate line driving circuit of the present invention can reduce the power consumption by preventing unnecessary gate line operation. In other words, no clock signal is provided to the gate line drivers which provide no driving signals except the gate line driver which provides a driving signal to a gate line presently. The present invention is also applicable to source line drivers for reducing unnecessary power consumption.

It will be apparent to those skilled in the art that various modifications and variations can be made in the gate driving circuit in a liquid crystal display of the present invention without departing from the spirit or scope of the invention. Thus, it is intended that the present invention cover the modifications and variations of this invention provided they come within the scope of the appended claims and their equivalents.

What is claimed is:

1. A gate driving circuit in a liquid crystal display having a liquid crystal panel with thin film transistors and pixel electrodes for displaying an image, a source driving circuit for applying video data to a source line in the liquid crystal panel, and a gate driving circuit for applying a driving signal to a gate line in the thin film transistors, the gate driving circuit comprising:

a plurality of gate line drivers connected in series for applying the driving signal to the gate line; and a plurality of clock generation controlling units corresponding to the plurality of gate line drivers each for controlling a timing of a clock signal to a respective gate line driver and each including a first flip flop connected as a toggle flip flop, thereby controlling a driving timing of the respective gate line driver.

2. The gate driving circuit as claimed in claim 1, wherein each of the plurality of clock generation controlling units is provided either within the respective gate line driver or outside of the respective gate line driver.

3. The gate driving circuit as claimed in claim 1, wherein each of the plurality of clock generation controlling unit includes:

the first flipflop being operative triggered at a rising edge of the clock signal;

a second flipflop being operative triggered at a falling edge of the clock signal;

an inverter for inverting an output of the second flipflop;

a first logic device for subjecting an output of the inverter and an output of the first flipflop to a logical operation; and a second logic device for subjecting an output of the first logic device and an external clock signal to a logical operation.

4. The gate driving circuit as claimed in claim 3, wherein the first and second logic devices are AND gates.

5. A gate driving circuit in a liquid crystal display having a liquid crystal panel for displaying an image, a gate driving circuit for applying a driving signal in a row direction of the liquid crystal panel, and a source driving circuit for applying a data signal in a column direction of the liquid crystal panel, the gate driving circuit comprising:

a plurality of gate line drivers connected in series for applying the driving signal to gate lines; and, a plurality of clock generation controlling units each for controlling a provision timing of a clock signal to a respective gate line driver in response to a first control signal and each including a first flip flop connected as a toggle flip flop, thus driving the plurality of gate line drivers in succession, and in response to a second control signal for shifting the plurality of gate line drivers in succession.

6. The gate driving circuit as claimed in claim 5, wherein the first control signal is a signal for enabling the respective gate line driver, and the second control signal is a signal from the respective gate line driver to which the first control signal is provided, for enabling a next gate line driver.

7. The gate driving circuit as claimed in claim 6, wherein the respective gate line driver to which the first control signal is provided provides driving signals to the gate lines in succession synchronized to the clock signal from the clock generation controlling unit, and provides the second control signal once a last driving signal is provided.

8. The gate driving circuit as claimed in claim 5, wherein each of the plurality of clock generation controlling units includes:

the first flipflop being operative triggered at a rising edge of the clock signal;

a second flipflop being operative triggered at a falling edge of the clock signal;

an inverter for inverting an output of the second flipflop;

a first logic device for subjecting an output of the inverter and an output of the first flipflop to a logical operation; and a second logic device for subjecting an output of the first logic device and an external clock signal to a logical operation.

9. The gate driving circuit as claimed in claim 8, wherein the first and second logic devices are AND gates.

10. The gate driving circuit as claimed in claim 5, wherein each of the plurality of clock generation controlling units is provided either within the respective gate line driver or outside of the respective gate line driver.

11. A gate driving circuit in a liquid crystal display having a liquid crystal panel for displaying an image, a gate driving circuit for applying a driving signal in a row direction of the liquid crystal panel, and a source driving circuit for applying a data signal in a column direction of the liquid crystal panel, the gate driving circuit comprising:

a plurality of gate line drivers connected in series for applying the driving signal to gate lines in the liquid crystal panel;

a first flipflop being operative in response to a first control signal which enables a respective gate line driver as a clock signal;

a second flipflop being operative in response to a second control signal from the respective gate line driver as a clock signal for enabling a next gate line driver after finishing enabling the respective gate line driver;

an inverter connected to an output terminal on the second flipflop;

a first logic device for subjecting an output of the inverter and an output of the first flipflop to a logical operation, and generating a reset signal for the first and second filpflops; and a second logic device for subjecting an output of the first logic device and an external clock signal to a logical operation, and for selectively providing an output signal to the respective gate line driver.

12. The gate driving circuit as claimed in claim 11, wherein the respective gate line driver is triggered at a rising edge of the output signal from the second logic device to provide a driving signal to the gate lines in succession, and provides the second control signal to be used as a clock signal for the second flipflop once a last driving signal is provided.

13. The gate driving circuit as claimed in claim 1, further including a second flip flop connected as a toggle flip flop.

14. The gate driving circuit as claimed in claim 5, wherein each clock generation controlling unit includes a second flip flop connected as a toggle flip flop.

15. The gate driving circuit as claimed in claim 11, wherein the first flip flop is connected as a toggle flip flop.

16. The gate driving circuit as claimed in claim 11, wherein the second flip flop is connected as a toggle flip flop.

* * * * *